US012188746B2

(12) United States Patent
Kretsinger

(10) Patent No.: US 12,188,746 B2
(45) Date of Patent: Jan. 7, 2025

(54) TWIST LOCK PISTOL RETENTION DEVICE

(71) Applicant: Shane Allan Kretsinger, North Branch, MN (US)

(72) Inventor: Shane Allan Kretsinger, North Branch, MN (US)

( * ) Notice: Subject to any disclaimer, the term of this patent is extended or adjusted under 35 U.S.C. 154(b) by 99 days.

(21) Appl. No.: 18/091,707

(22) Filed: Dec. 30, 2022

(65) Prior Publication Data

US 2024/0175660 A1 May 30, 2024

Related U.S. Application Data

(60) Provisional application No. 63/428,803, filed on Nov. 30, 2022.

(51) Int. Cl.
*F41C 33/04* (2006.01)
*F41C 33/02* (2006.01)

(52) U.S. Cl.
CPC ..... *F41C 33/045* (2013.01); *F41C 33/0263* (2013.01)

(58) Field of Classification Search
CPC ..... F41C 33/0263; F41C 33/045
USPC ..... 224/243, 244
See application file for complete search history.

(56) References Cited

U.S. PATENT DOCUMENTS

| | | | | |
|---|---|---|---|---|
| 6,189,751 | B1 * | 2/2001 | Tserng | F41C 33/041 224/198 |
| 9,683,809 | B2 * | 6/2017 | Fowler | F41C 33/0263 |
| 10,563,952 | B2 * | 2/2020 | Tedder | F41C 33/0263 |
| 2010/0252591 | A1 * | 10/2010 | Lu | F41C 33/0263 224/243 |
| 2024/0175660 | A1 * | 5/2024 | Kretsinger | F41C 33/045 |

* cited by examiner

*Primary Examiner* — Justin M Larson
(74) *Attorney, Agent, or Firm* — Westman, Champlin & Koehler, P.A.

(57) ABSTRACT

A method and device for interlocking with a surface of a firearm to retain the firearm in a holster. The device is a housing having an outer component and an inner component wherein the inner component and outer component are rotationally secured to one another; and a sliding plate that slidably connected to the inner component and the sliding plate comprising a firearm catch element configured to engage with a surface of the firearm when the sliding plate is in a second position and disengage with the surface of the firearm when the sliding plate is in a first position, wherein in the second position the sliding plate is linearly displaced with respect to the inner component and rotationally displaced with respect to the outer component.

21 Claims, 15 Drawing Sheets

TWIST LOCK PISTOL RETENTION DEVICE

This application claims priority to and the benefit of U.S. provisional patent application Ser. No. 63/428,803, filed Nov. 30, 2022, the contents of which are incorporated herein in their entirety.

BACKGROUND

Belt type holsters for handguns are known to have been in use since at least the 1840s. While early holsters were little more than an open pocket that provided a gun carrying location outside the operators clothing, modern holsters have improved substantially since the earliest specimens.

Recently, gun to holster retention devices that physically lock the gun into the holster have become sought-after. Operators ranging from military, to law enforcement officers, and every day civilians alike recognize the benefits of having a holster that is equipped to prevent the gun from accidentally falling out of the holster while the operator is in motion, or from being easily taken from the holster by others when the operator's attention is otherwise distracted.

Many military and law enforcement agencies have increased requirements for duty holsters in use by their members. These increased requirements often include enhanced levels of gun-to-holster retention that meet a specified criteria set forth by governing members of the respective agency, in order to meet adopted safety standards. Some military and law enforcement agencies are now requiring multiple firearm to holster retention devices to create a redundancy of retention, and automatic locking capability to provide higher levels of safety than was before possible.

Gun-to-holster retention has historically been provided by a mechanical device that includes a very basic blocking device such as a tie down lanyard, a strap affixed with a snap, or similar safety bale designed to keep the gun inside the holster.

The more current forms of retention devices available are designed to engage with features that are common on the gun such as the trigger guard or the ejection port.

Retention devices that work in this manner result in a release mechanism that requires an operator to locate and physically manipulate the release mechanism with their fingers on the hand that would otherwise be employed to grip the firearm for removal from the holster.

Retention latching mechanisms such as these are located on the holster itself and as such, are not visible to the user at the time the mechanism needs to be located and operated. These retention devices must be located by feel or muscle memory and repetitive training methods.

Placement of a latching mechanism of current designs, no matter how intuitive the location, always includes risk of failure under operator stress and loss of speed.

Due to the need for operators to be able to quickly, reliably, and easily remove the gun from the holster in the event of a high stress situation without searching for a release mechanism, a retention device that automatically functions without requiring the operator to locate additional levers or switches for either locking or unlocking operations is needed.

SUMMARY

One aspect of the present disclosure relates to a device for engaging with a surface of a firearm to retain the firearm in a holster, the device comprising a housing having an outer component and an inner component wherein the inner component and outer component are rotationally secured to one another; and a sliding plate that slidably connected to the inner component and the sliding plate comprising a firearm catch element configured to engage with a surface of the firearm when the sliding plate is in a second position and disengage with the surface of the firearm when the sliding plate is in a first position, wherein in the second position the sliding plate is linearly displaced with respect to the inner component and rotationally displaced with respect to the outer component.

In one or more embodiments the outer housing comprises a boss which engages with a surface of the sliding plate as the inner component and outer component rotate with respect to one another and wherein the sliding plate is linearly displaced by rotational interaction between the inner and outer housing.

In one or more embodiments, the sliding plate is a spring biased sliding plate wherein one or more springs are provided in one or more channels on the sliding plate and as the inner component and outer component rotate with respect to one another, the springs are either relaxed or engaged.

The outer component is configured for mounting to a holster belt mount or holster quick detachment accessory.

The device is comprised of metal, plastic, rubber, carbon fiber, composite materials, or combinations thereof.

In one or more embodiments the device has a detent ball bearing assembly configured to control movement between the inner component and outer component.

The device has a tensioning screw operably coupled to the outer component and configured to adjust tensioning for the detent ball bearing assembly.

The device has traction geometry configured to allow for an intermittent stopping force to be applied by detent ball bearing assembly to the rotation between the outer component and inner compound which provides one or both of an audial or tactile confirmation of axial movement between the inner and outer components.

In one or more embodiments the surface of the firearm is an ejection port on the firearm.

Another aspect of the present disclosure relates to a firearm-to-holster retention device comprising a housing having two housing components rotatably affixed to one another and a sliding plate that is linearly moveable and secured to one of the two rotatably affixed housing components and the sliding plate comprising a firearm catch mechanism protruding therefrom for engaging with a surface of a firearm when one of the two housing components is rotated with respect to the other housing component and disengaging with a surface of the firearm when one of the two housing components is reciprocally rotated with respect to the other.

The device is configured to affect an interference fit between the firearm and a holster when the device is secured to the holster and wherein the interference fit is affected by rotation of the device with respect to the holster and is removed by reciprocal rotation of the device with respect to the holster.

The device is configured with a surface allowing the device to be mounted between the holster and a holster belt mount or holster quick detachment accessory.

The device is mounted to a holster base and wherein an axle joins the holster base to one housing component of the device and wherein the axle comprises a screw, bolt, rivet, post, or built-in post allowing the device to be secured to the holster base while allowing the housing component to rotate axially to a selected degree as the holster base remains stationary.

In one or more embodiments the sliding plate is slidably connected to on one of the two housing components rotatably affixed to one another.

In one or more embodiments a boss which, when driven by the rotation of one of the two housing components rotatably affixed to one another, interacts with the sliding plate causing the sliding plate to be moved from a first position to a second position which also moves the firearm catch mechanism from a first position to a second position.

In one or more embodiments the sliding plate is linearly biased by one or more springs positioned in one or more channels on the sliding plate such that as manual force is applied to the sliding plate by way of rotational movement of one of the two housing components rotatably affixed to one another, the sliding plate is moved from the first position to the second position.

Yet another aspect of the present disclosure relates to a method for retaining a firearm in a holster worn on a user, the method comprising securing a housing comprising a catch mechanism that is moveable to engage and disengage with a surface of the firearm to the holster worn by the user; inserting the firearm into the holster; rotating a first component of the housing a selected degree with respect to a second component of the housing to move the catch mechanism to engage the surface of the firearm; and securing the firearm in the holster as the catch mechanism is engaged with the surface of the firearm.

Removing the firearm from the holster comprises rotating the first component of the housing with respect to the second component to disengage the catch mechanism from the surface of the firearm and removing the firearm from the holster.

Removing the firearm from the holster comprises rotating the first component of the housing with respect to the second component using forward motion and rotating the first component approximately 12 degrees with respect to the second component to disengage the catch mechanism from the surface of the firearm and move the catch mechanism out of the way for removing the firearm from the holster.

The surface of the firearm is an ejection port of the firearm and wherein the catch element engages with the ejection port providing an interference fit between the firearm and the holster for securely retaining the firearm within the holster.

The catch mechanism is positioned on one of a mounting base of the housing, a rotating plate of the housing, or a sliding plate of the housing.

DETAILED DESCRIPTION

Figure 2:
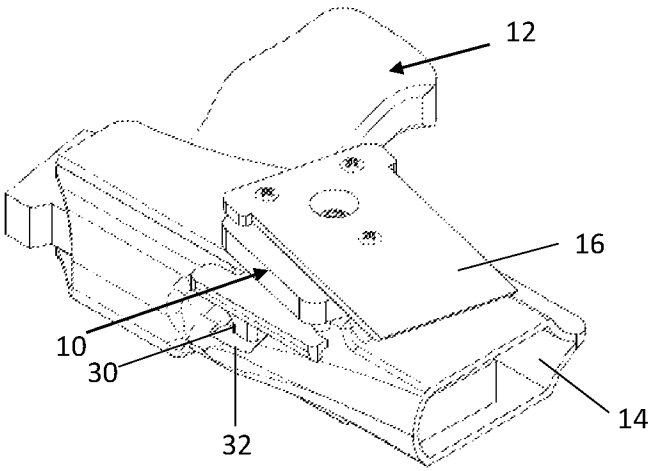
FIGS. 1-2 are side perspective views of a twist lock retention device according to one or more embodiments described herein and mounted to a holster for a firearm assembly.
Figure 1:
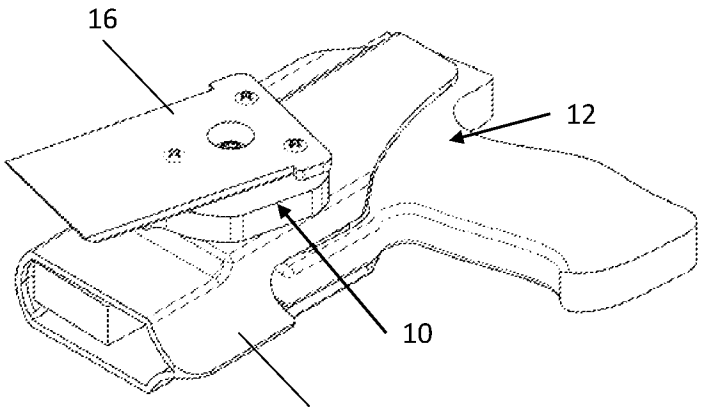
Figure 4:
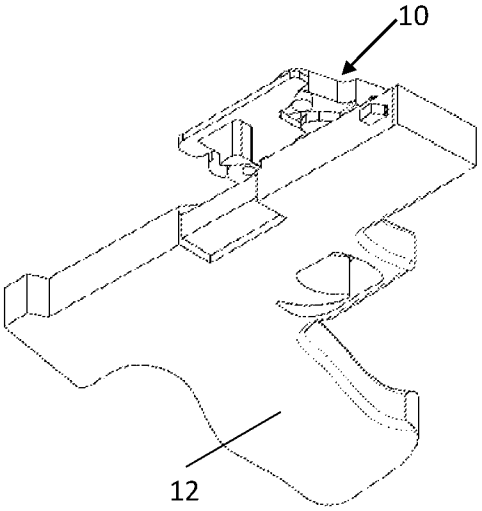
FIG. 4 is a bottom perspective view of the device as positioned to engage with a firearm.
Figure 3:
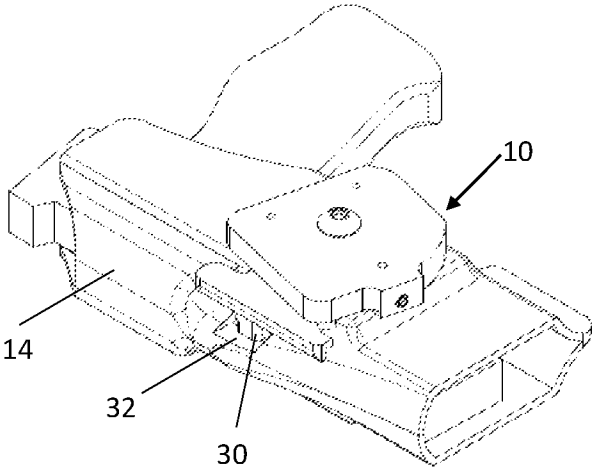
FIG. 3 is a side perspective view of the device mounted to a holster with a firearm therein and with body mounting equipment removed to show a rear face of the device.
Figure 6:
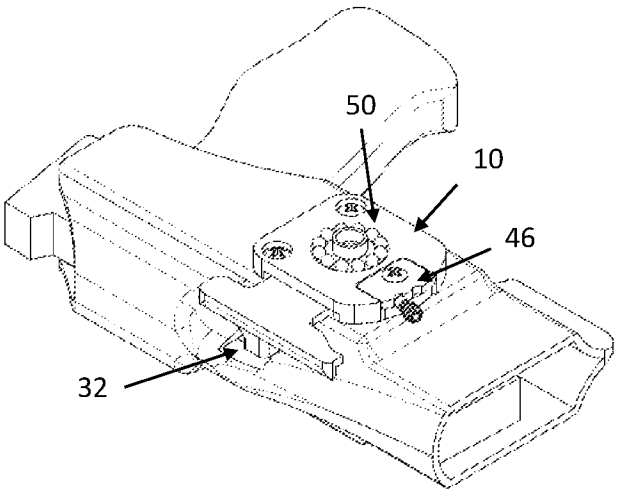
FIGS. 5-6 are side perspective views of the device mounted to a holster with a firearm therein and with a rear outer housing of the device removed to illustrate interior traction components of the device.

Described herein is device to secure a firearm in a holster. The device described herein is secured to the firearm holster and comprises a rotatable housing which automatically locks the firearm in the holster when the firearm is inserted into the holster. To remove the firearm from the holster, the user simply rotates the housing to unlock the firearm and pull the firearm out of the holster. The rotation required is minimal and as a user carries out the forward movement generally used to retrieve the firearm from the holster, this forward movement can be used by the user to rotate the housing and smoothly disengage the firearm from the device and remove the firearm from the holster.

In one or more embodiments, the device described herein is used in connection with a handgun that is holstered on a user's body. For example, the holster may be worn on the body of a user, such as on the user's hip. However, the embodiments of the device described herein are not limited in use to any single type of holster or firearm. The embodiments described herein are non-limiting examples of a rotatable device for automatically locking, securely engaging with, or otherwise securely retaining a firearm in a holster. The device described herein prevents unwanted or unintentional removal of the firearm from the holster.

The device comprises a sliding plate component which is driven by axial movement of a first housing of the device in relation to a holster base component of the device. In one or more embodiments, the sliding plate comprises one or more firearm interface devices integrated into, permanently, or removably affixed to the sliding plate.

In one or more embodiments, the sliding plate may be configured to interface with a firearm interface device which is mounted on, built into, fixedly, or removably attached to the holster.

In one or more embodiments, the device comprises a rotatable housing where rotation of the housing moves a catch element such as a projection, knob or boss, between positions of engagement and disengagement with a surface of the firearm.

In one embodiment of the device, the surface of the firearm is an ejection port on the firearm. When the catch element is engaged with the ejection portion on the firearm, the firearm is retained or otherwise secured within the holster. The housing is then rotated to move the catch element and disengage the catch element from the ejection port, thus allowing for manual removal of the firearm from the holster. Additionally, or alternatively, the surface of the firearm may be a trigger housing and the device may be configured with one or more catch elements to contact one or more surfaces of the firearm.

Rotation of the rotatable housing required to move the catch element is minimal, for example, in one embodiment a rotation of approximately 12 degrees is sufficient to move the catch element between the positions of engagement and disengagement with a surface of the firearm. The degree of rotation may be less than approximately 12 degrees or more than approximately 12 degrees in order to effect sufficient movement of the sliding plate to move the catch element between engagement and disengagement positions with respect to a surface of the firearm and/or holster.

When the firearm is returned to the holster, the firearm is automatically locked or secured in the holster as the catch element is moved into contact with the ejection port on the firearm as the housing is rotated. The housing comprises a cam which interfaces with a sliding arm and as the housing is rotated, the cam pushes the slider to effect movement of the catch element to a disengaged position for removal of the firearm. The catch element is essentially moved out of the way of the ejection port for smooth removal of the firearm. The cam may be a spring loaded cam for moving the catch element in one or both directions.

In one or more embodiments, the device allows the user to draw the firearm from the holster while moving their hand in a forward motion so the firearm is directly removed from the holster without the user having to look down at the holster.

When the device is rotated to a first position wherein the catch element would be in a position to engage with the surface of the firearm, but the firearm is not in the holster, the device is constructed with a sufficient spring tension for re-holstering the firearm without crashing the firearm in the holster.

The device described herein may also be used alone or in combination with one or more additional firearm retention devices to provide a holstering system of multiple levels of securing the firearm in the holster.

In one or more embodiments, the device may be configured to engage with one or more surfaces on the firearm. For example, the device may be configured to rotatably engage or interlock with ejection ports on one or both sides of a firearm. For example, the catch mechanism such as the projection, knob or boss may have dimensions that allow the catch mechanism to extend across a firearm surface to engage with an ejection port on an opposite side of the firearm from the device. This may be in addition to the catch mechanism engaging with the ejection port on the same side of the firearm at the same time. Additionally or alternatively, the device may be configured to engage with the trigger housing of the firearm.

The rotatably driven movement of the catch element for locking or securing the firearm in the holster may comprise a spring loaded cam and/or the device may comprise a rotating shaft having mechanical holding devices such as dogs. In one or more embodiments, the firearm is inserted into the holster, the firearm passes a first, larger dog which stops at a trigger guard for the firearm. As the device is rotated, a port comprising a ramped surface engages a second dog, which may be a ramped dog and thus rotating the device out of the way to avoid the trigger guard. This device may be used with a firearm having a light source mounted thereon as the device moves past the light source. This embodiment provides an advantage as a firearm with a light source can be safely secured in holster using rotative action for engaging and disengaging the device with the firearm.

The device of any one or more embodiments described herein and/or one or more components may be comprised of metal, plastic, rubber, carbon fiber, composite materials, or combinations thereof.

In further detail as illustrated in FIGS. 1-13, a retention device 10 for securing a firearm 12 in a holster 14 may be secured to a mounting mechanism 16 which allows the device to be securely used with a holster 14 and/or holstering equipment. The device 10 comprises a housing 20, a mounting base 22, and a sliding plate 24 that is driven by rotational interaction of the housing 20 around an axis or axle 21 axially affixed between the housing 20 and the mounting base 22. In use, the mounting base 22 may be stationarily affixed or otherwise secured to holstering equipment worn by a user whereas the housing 20 then interfaces with the holster 14 and firearm 12.

The axle 21 may join the mounting base 22 to the housing 20. The axle 21 may comprise a screw, bolt, rivet, built in post, or similar device allowing the two components to be joined while allowing the housing 20 to rotate axially to a specified degree such as approximately 12 degrees with respect to the mounting base 22.

Referring to a first side or face of the device 10 which abuts or faces the holster 14 and/or firearm 12, the device 10 supports the sliding plate 24. The sliding plate 24 has a first end 26 that is slidable within connection to the housing 20 and rotatable therewith. A second end 28 of the sliding plate 24 supports a catch mechanism 30 for contacting and engaging with an ejection port surface 32 on the firearm 12 as the sliding plate 24 is rotated and moved linearly.

The housing 20 may have a recessed surface 39 thereon providing a surface for the sliding plate 24 to move linearly along a length of the housing 20. The sliding plate 24 may have a channel 35 there along for providing clearance for the axle hardware rotatably connecting the housing 20 to the mounting base 22 and allowing for the sliding plate 24 to slide along the housing 20. The sliding plate 24 is carried by the housing 20 and thus rotation of the housing 20 with respect to the mounting base 22 causes the sliding plate 24 to also rotate with respect to the mounting base 22. The first end of the sliding plate 24 has a surface that may slide or ride against a protrusion 34 positioned on the mounting base 22 as part of moving the sliding plate 24 from a first position to a second position. The sliding plate 24 is biased with respect to the housing 20 by one or more springs 36 located in one or more channels 38 and thus the sliding plate 24 is capable of reciprocal movement within or along the recessed surface or channel 39 in the housing 20.

When manual force is applied to the sliding plate 24 by way of rotational movement of one of the mounting base 22 or the housing 20 with respect to the other, the sliding plate 24 is moved from the first position, which may be considered a closed position into a second position which may be considered an open position and the spring or springs 36 compress. When manual force is removed or re-directed, the sliding plate 24 is returned to the first or closed position with assistance of the spring(s) 36. In the closed position, the first end of the sliding plate 24 is moved along the channel 39 in the housing 20 as is the catch mechanism 30 such that when a firearm 12 is in the holster 14 connected with the device 10, the catch 30 is engaged with the ejection port 32 of the firearm 12. In the open position, the sliding plate 24 is moved and rotated as is the catch 30 which is moved out of engagement or contact with the ejection port 32 thus freeing the firearm 12 for removal from the holster 14.

To provide a compact device 10, the mounting base 22 may have an opening or recessed area 23 in which the housing 22 sits and is rotatably connected thereto.

Figure 5:
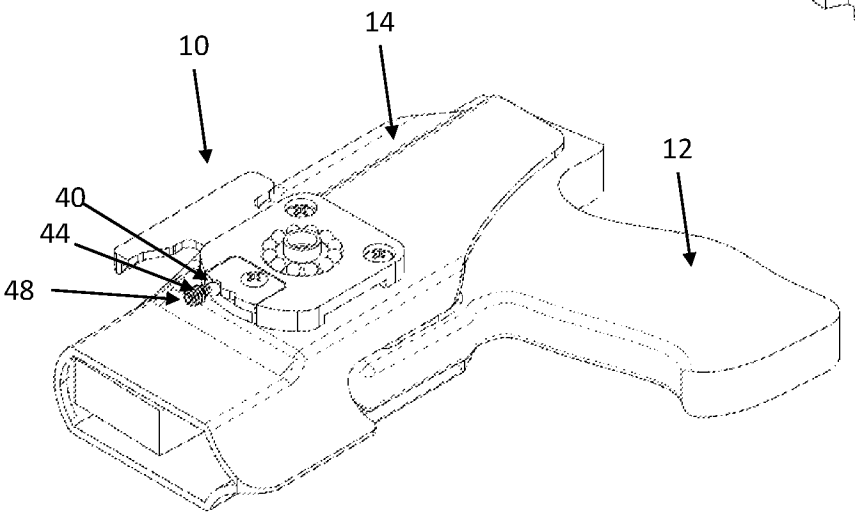
Figure 7C:
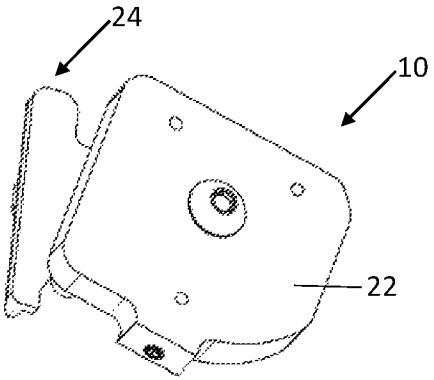
FIGS. 7A, 7B, and 7C illustrate a rear face of the device and side view thereof
Figure 7B:
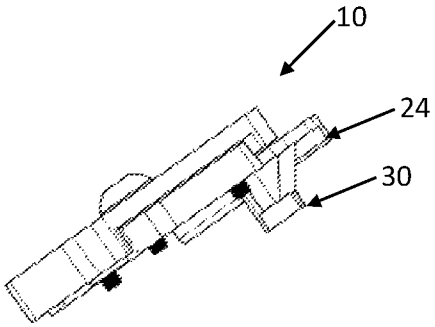
Figure 7A:
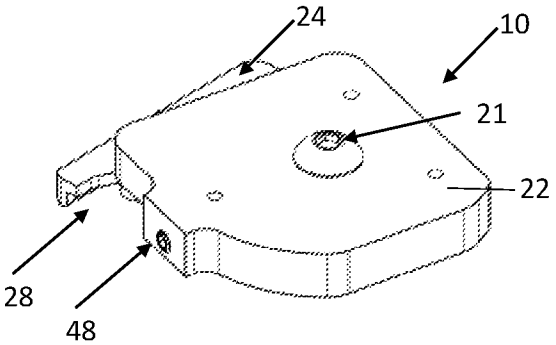
Figure 9:
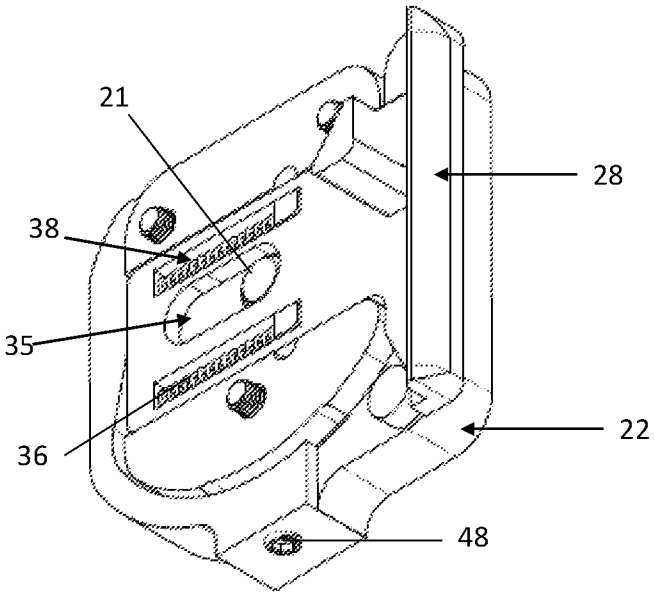
FIG. 8 and FIG. 9 are front perspective views of the device.
Figure 8:
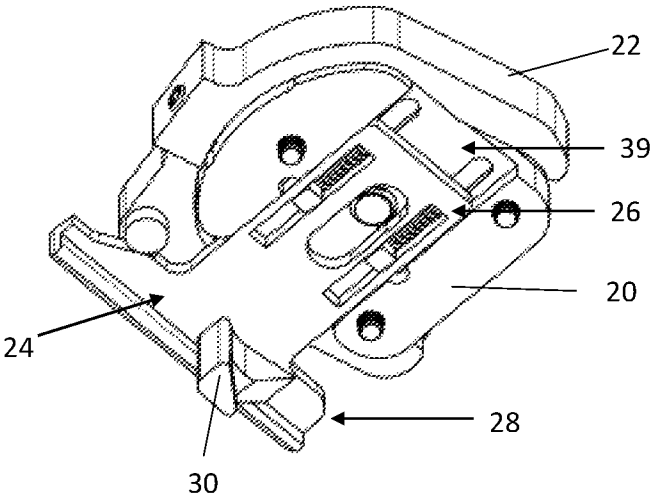
Figure 11:
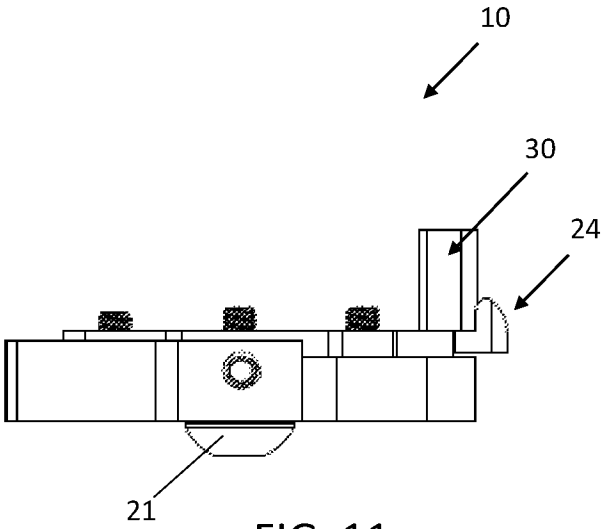
FIG. 11 is a side view of the device.
Figure 10:
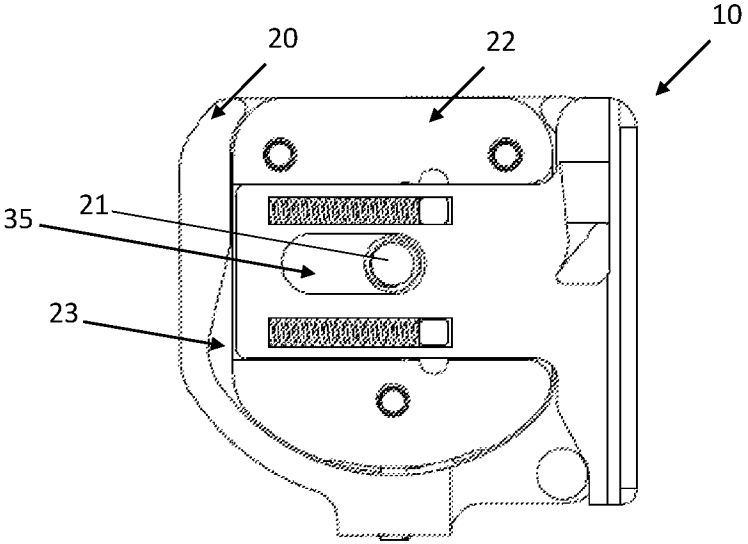
FIG. 10 is a front view of the device.
Figure 13:
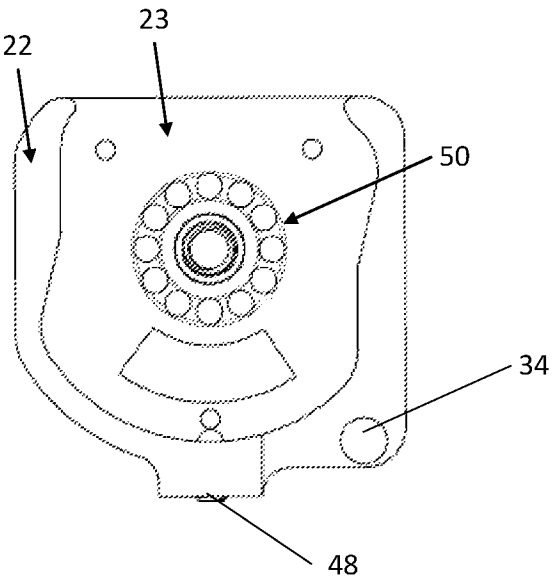
FIG. 12 and FIG. 13 are front views of the device with a sliding plate removed to illustrate interior traction components of the device.
Figure 12:
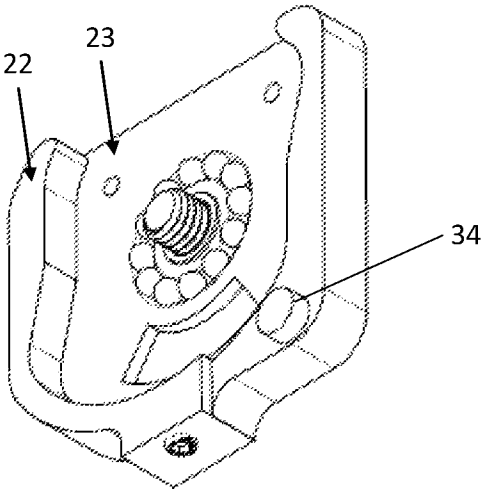
Figure 15:
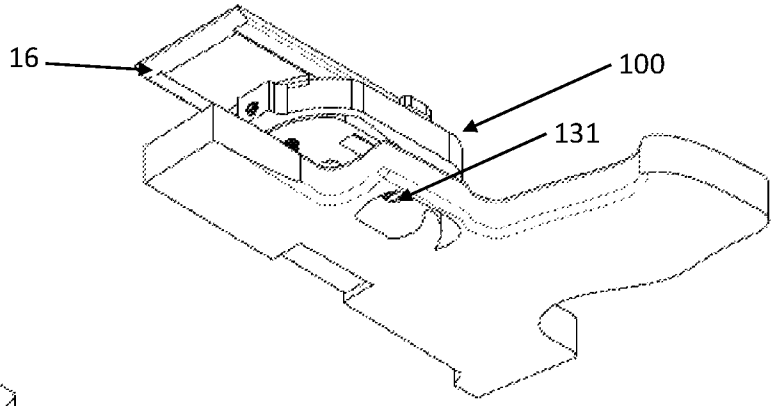
FIG. 14 and FIG. 15 are opposing side perspective views of an additional embodiment of a twist lock retention device according to one or more embodiments described herein and wherein the device is engaged with a firearm.
Figure 14:
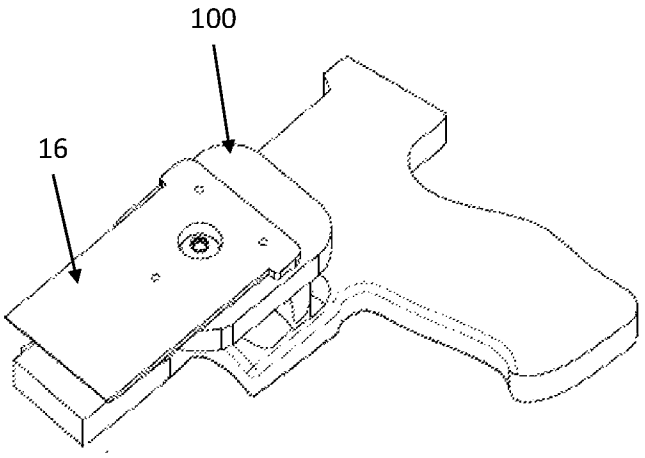
Figure 16:
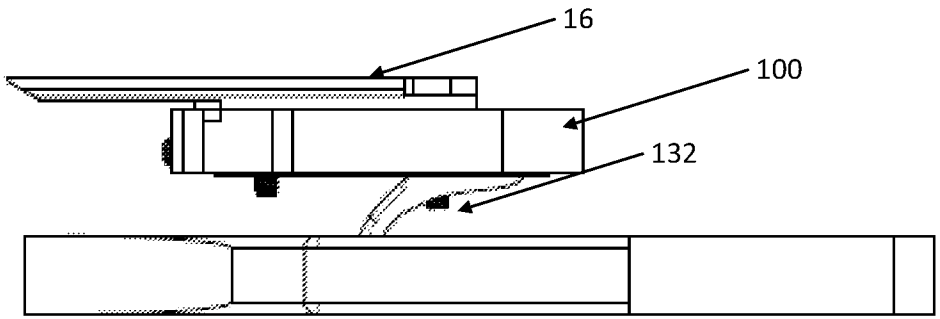
FIG. 16 is a bottom view of the device in an engaged or locked position where the device is engaged with a firearm.
Figure 17:
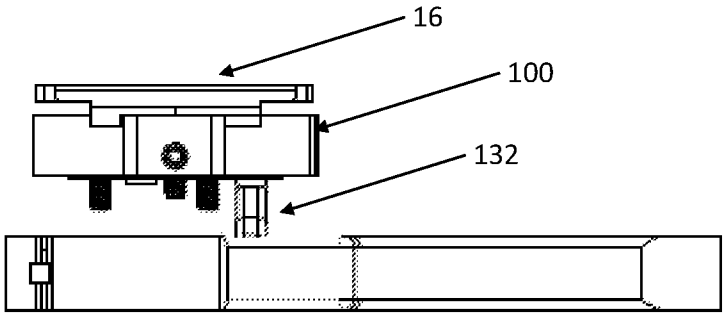
FIG. 17 is a top view of the device in an unlocked position where the device is disengaged from a firearm.
Figure 19B:
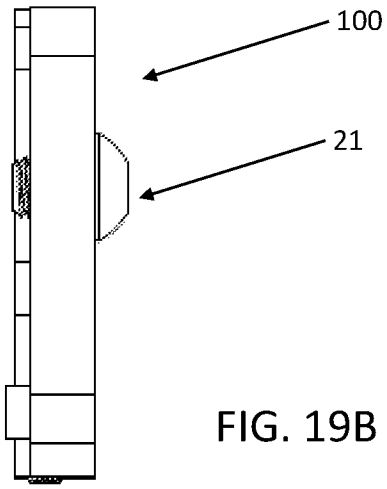
FIG. 19A and FIG. 19B are side views of the device in an unlocked position.
Figure 19A:
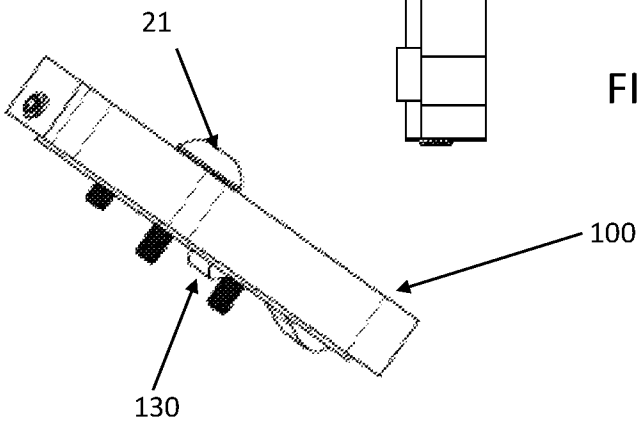
Figure 23:
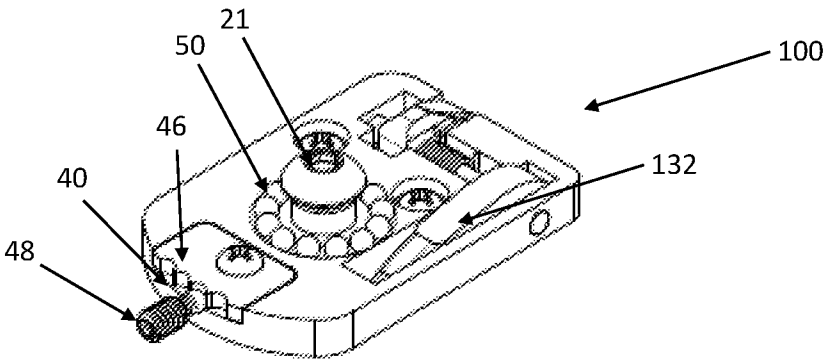
FIG. 23 is rear side view of the device with the outer housing or cover removed for illustration of the interior components.
Figure 22:
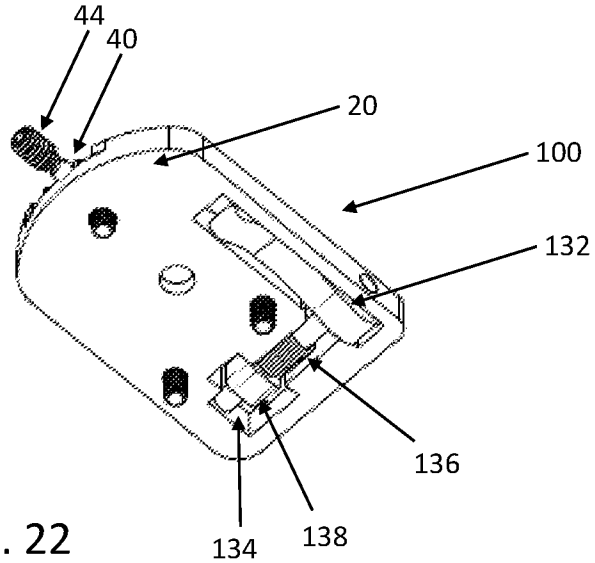
FIG. 22 is front side view of the device with the outer housing or cover removed for illustration of the interior components.
Figure 25:
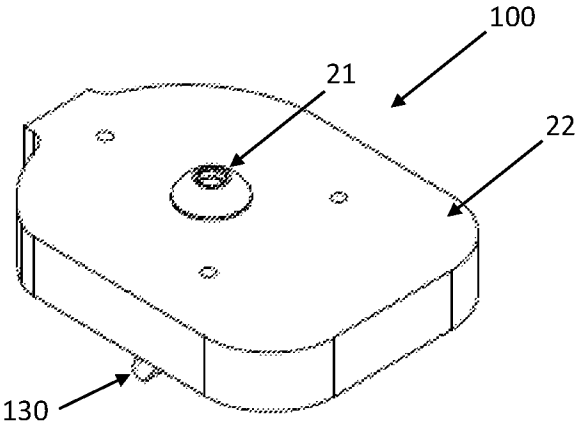
FIG. 25 is rear side view of the device.
Figure 24:
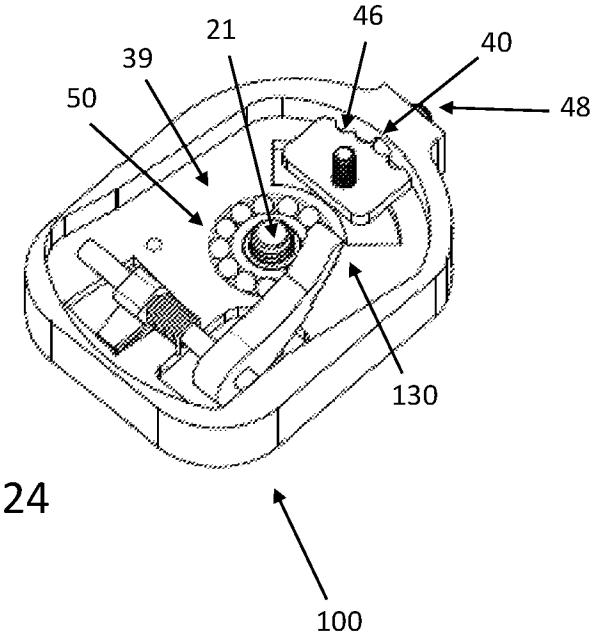
FIG. 24 is front side view of the device with a ramped plated removed for illustration of the interior components.
Figure 27:
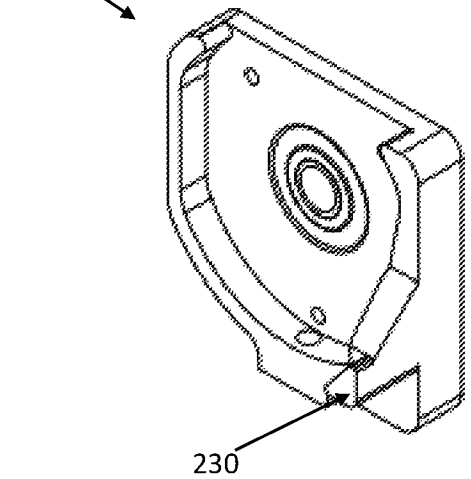
FIG. 27 is a front perspective view thereof.
Figure 26:
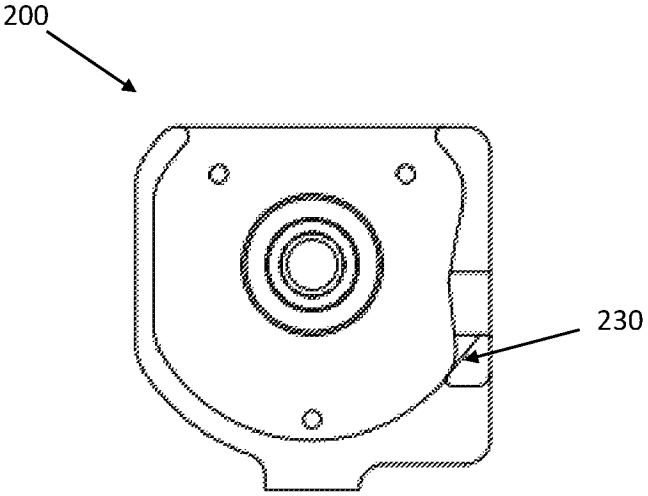
FIG. 26 is a front view of another embodiment of a mounting base of a retention device.
Figure 29:
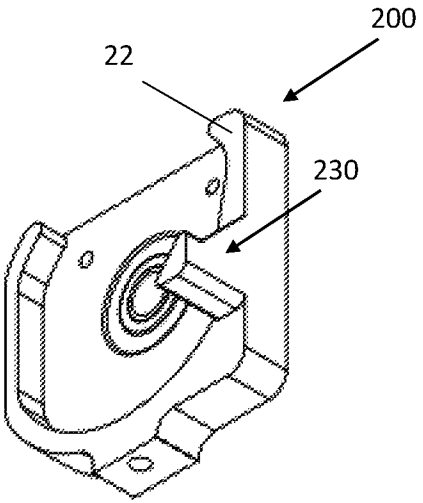
FIG. 28 and FIG. 29 are additional front perspective views thereof.
Figure 28:
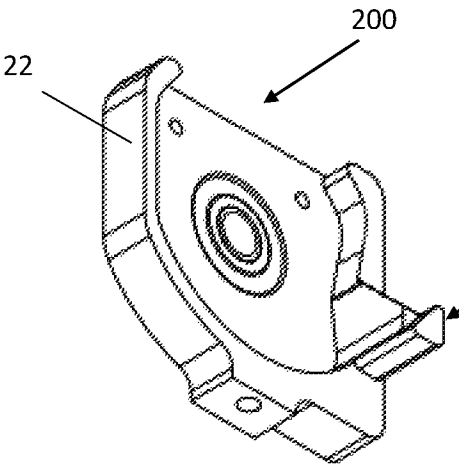
Figure 30:
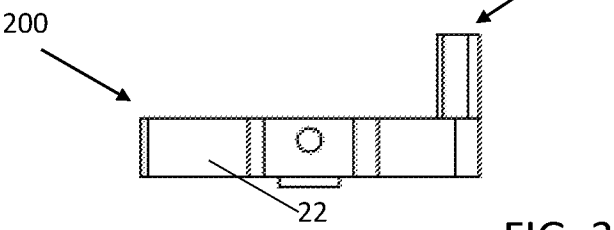
FIG. 30 is a side view thereof.

Referring to a second side or face of the device 10 which abuts or faces the user of wearer of the device 10 or otherwise is opposite the firearm 12, the device 10 may affect rotation and/or movement of the element 30 configured to engage with the firearm 12 with a detent ball bearing assembly 40 which provides for controlled rotational movement between the housing 20 and the mounting base 22. The detent ball bearing assembly 40 is shown in FIGS. 5 and 5 and exposed and illustrated in further detail in FIGS. 22-24. The device 10 comprises a bearing located in an aperture granting the bearing access to a space or void which provides clearance for the axial movement between the housing 20 and the mounting base 22. The detent ball bearing 40 is driven into one or more adjacent voids, for example those of scallops 46, by a spring 44 which may be adjustably tensioned by a tensioning screw 48. The spring 44 biases the ball 40 and as the housing 20 is rotated about axis 21, the scallops 46 are also rotated and the ball bearing 40 is moved along the scallops 46. The intermittent stopping force as the scallops 46 are moved along the ball bearing 40 results in audible as well as a tactile confirmation of progress of the axial movement of the housing 20 and/or catch element 30. There may be one or more surfaces on the scalloped section, for example two, three, four or more thus providing a plurality of the tactile or audible confirmations of movement or "clicks." This assembly may be considered a traction mechanism for the rotational movement of housing 20. Further, in one or more embodiments, this traction mechanism may be an interchangeable insert that may be replaced when worn, or altered to provide traction to the detent ball in a variety of configurations so as to suit operator preference. Additional surfaces 50 may be provided to facilitate the rotation of the housing 20 with respect to the mounting base 22.

In another embodiment illustrated in FIGS. 14-25 a retention device 100 for securing a firearm 12 in a holster 14 may be secured to a mounting mechanism 16 which allows the device to be securely used with a holster 14 and/or holstering equipment. The device 100 comprises a housing 20, a mounting base 22, and spring loaded catch element 130 that are driven by rotational interaction of the housing 20 around an axis or axle 21 axially affixed between the housing 20 and the mounting base 22.

The axle 21 may join the mounting base 22 to the housing 20 in a manner similar to one or more embodiments described above. The axle 21 may comprise a screw, bolt, rivet, built in post, or similar device allowing the two components to be joined while allowing the housing 20 to rotate axially to a specified degree such as approximately 12 degrees.

Referring to a first side or face of the device 100 which abuts or faces the holster 14 and/or firearm 12, the housing 20, which may be referred to as a rotatable plate, is movable and supports the catch element 130 for contacting and engaging with the trigger housing surface 131 on the firearm 12.

Figure 18:
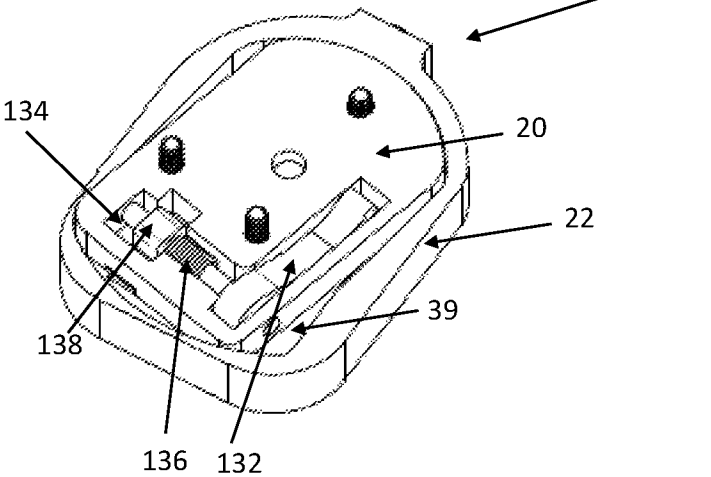
FIG. 18 is a front perspective of the device illustrating the mechanism for engaging with the firearm.
Figure 21:
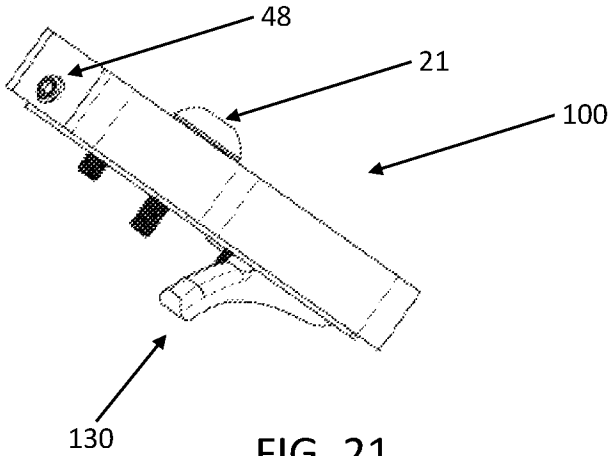
FIG. 21 is a side of the device where the mechanism is in an engaged or locked position.
Figure 20:
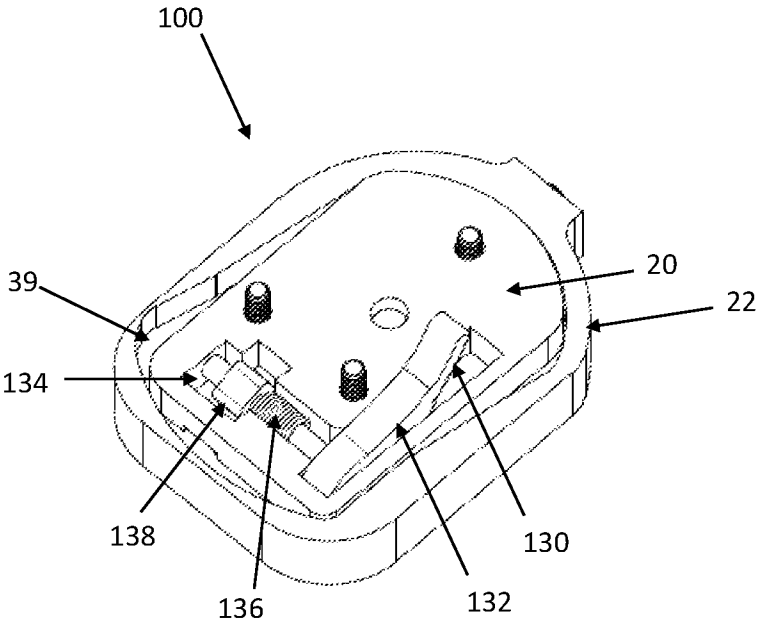
FIG. 20 is a front perspective of the device illustrating the mechanism for engaging with the firearm where the mechanism is in an engaged or locked position.

The catch element 130 comprises at least one dog 132 which, when driven by the rotation of the housing 20 with respect to the stationary mounting base 22 such that when manual force is applied to the housing 20 by way of rotational movement of the housing 20, the housing 20 is moved from the first position, which may be considered a closed position into a second position which may be considered an open position. A spring or springs 136 relax or compress to move the dog 132 between a first and second position as illustrated in FIGS. 18 and 20. The spring 136 may be a helical torsion spring or other torsion spring positioned to effect pivoting or moving of the dog 132 between the first and second positions for engaging and disengaging with the trigger housing.

Referring to the first side or face of the device 100, as the firearm 12 is inserted into the holster 14 which is secured to device 100, the firearm 12 is moved past the first dog 132 which may be a larger dog with respect to additional dogs. The first dog 132 stops at the trigger guard for the firearm 12. As the device 100 is rotated, a port 134 comprising a ramped surface 138 may engage a second dog, which may be a ramped dog and thus rotating the device out of the way to avoid the trigger guard. This device may be used with a firearm 12 having a light source mounted thereon as the device moves past the light source.

The device 100 illustrated in FIGS. 14-25 may affect rotation and/or movement of the housing 20 with a detent ball bearing assembly 40 similar to that described above with respect to the one or more embodiments of the device 100.

The device 100 may be secured to the holster and/or mounting equipment in a similar manner as device 10.

Another embodiment of a mounting base 22 of a device 200 is illustrated in FIGS. 26-30. In such an embodiment, the device 200 is configured for direct rotation of the catch element 230. The catch element 230 is integrated directly into the mounting base 22 of the device 10, thus eliminating the inclusion of a sliding plate element. Such an embodiment allows the catch element 230 to be rotated directly into an engagement position with a surface of the firearm and rotated in a reverse direction to disengage the catch element 230 from the firearm. The housing 20 of the device 200 and other components are removed for ease of illustration of the mounting base 22 with the catch element 230 integrated directly thereon.

In any one or more of the embodiments described herein, the mounting base 22 may be affixed to the mounting mechanism 16 and thus the device affixed to holstering equipment, holster belt, or other surfaces with adhesive, mechanical fasteners, or other semi-permanent methods. Alternatively, the mounting base 22 is molded, machined, or otherwise built-in to holstering equipment worn on the body of the user and/or the equipment strapped to the user.

Although the present disclosure has been described with reference to preferred embodiments, workers skilled in the art will recognize that changes may be made in form and detail without departing from the spirit and scope of the disclosure.

What is claimed:

1. A device for engaging with a surface of a firearm to retain the firearm in a holster, the device comprising:

a housing having an outer component and an inner component wherein the inner component and outer component are rotationally secured to one another about an axis; and a sliding plate that slidably connected to the inner component and the sliding plate comprising a firearm catch element configured to engage with a surface of the firearm when the sliding plate is in a second position and disengage with the surface of the firearm when the sliding plate is in a first position, wherein in the second position the sliding plate is linearly displaced perpendicular to the axis with respect to the inner component and rotationally displaced with respect to the outer component.

2. The device of claim 1 wherein the outer component comprises a boss which engages with a surface of the sliding plate as the inner component and outer component rotate with respect to one another and wherein the sliding plate is linearly displaced by rotational interaction between the inner and outer housing.

3. The device of claim 1 wherein the sliding plate is a spring biased sliding plate wherein one or more springs are provided in one or more channels on the sliding plate and as the inner component and outer component rotate with respect to one another, the springs are either relaxed or engaged.

4. The device of claim 1 wherein the outer component is configured for mounting to a holster belt mount or holster quick detachment accessory.

5. The device of claim 1 wherein the device is comprised of metal, plastic, rubber, carbon fiber, composite materials, or combinations thereof.

6. The device of claim 1 and further comprising a detent ball bearing assembly configured to control movement between the inner component and outer component.

7. The device of claim 6 and further comprising a tensioning screw operably coupled to the outer component and configured to adjust tensioning for the detent ball bearing assembly.

8. The device of claim 6 and further comprising traction geometry configured to allow for an intermittent stopping force to be applied by detent ball bearing assembly to the rotation between the outer component and inner compound which provides one or both of an audial or tactile confirmation of axial movement between the inner and outer components.

9. The device of claim 1 wherein the surface of the firearm is an ejection port on the firearm.

10. A firearm-to-holster retention device comprising a housing having two housing components rotatably affixed to one another about an axis and a sliding plate that is linearly moveable perpendicular to the axis with respect to the two housing components and secured to one of the two rotatably affixed housing components and the sliding plate comprising a firearm catch mechanism protruding therefrom for engaging with a surface of a firearm when one of the two housing components is rotated with respect to the other housing component and disengaging with a surface of the firearm when one of the two housing components is reciprocally rotated with respect to the other.

11. The device of claim 10 wherein the device is configured to affect an interference fit between the firearm and a holster when the device is secured to the holster and wherein the interference fit is affected by rotation of the device with respect to the holster and is removed by reciprocal rotation of the device with respect to the holster.

12. The device of claim 11 wherein the device is configured with surface allowing the device to be mounted between the holster and a holster belt mount or holster quick detachment accessory.

13. The device of claim 10 wherein the device is mounted to a holster base and wherein an axle joins the holster base to one housing component of the device and wherein the axle comprises a screw, bolt, rivet, post, or built-in post allowing the device to be secured to the holster base while allowing the housing component to rotate axially to a selected degree as the holster base remains stationary.

14. The device of claim 10 wherein the sliding plate is slidably connected to on one of the two housing components rotatably affixed to one another.

15. The device of claim 14 and the housing further comprising a boss which, when driven by the rotation of one of the two housing components rotatably affixed to one another, interacts with the sliding plate causing the sliding plate to be moved from a first position to a second position which also moves the firearm catch mechanism from a first position to a second position.

16. The device of claim 15 wherein the sliding plate is linearly biased by one or more springs positioned in one or more channels on the sliding plate such that as manual force is applied to the sliding plate by way of rotational movement of one of the two housing components rotatably affixed to one another, the sliding plate is moved from the first position to the second position.

17. A method for retaining a firearm in a holster worn on a user, the method comprising:

securing a housing comprising a catch mechanism that is moveable to engage and disengage with a surface of the firearm to the holster worn by the user;

inserting the firearm into the holster;

rotating a first component of the housing a selected degree about an axis with respect to a second component of the housing to move the catch mechanism perpendicular to the axis with respect to the first and second components to engage the surface of the firearm; and securing the firearm in the holster as the catch mechanism is engaged with the surface of the firearm.

18. The method of claim 17 wherein removing the firearm from the holster comprises rotating the first component of the housing with respect to the second component to disengage the catch mechanism from the surface of the firearm and removing the firearm from the holster.

19. The method of claim 18 wherein removing the firearm from the holster comprises rotating the first component of the housing with respect to the second component using forward motion and rotating the first component approximately 12 degrees with respect to the second component to disengage the catch mechanism from the surface of the firearm and move the catch mechanism out of the way for removing the firearm from the holster.

20. The method of claim 17 wherein the surface of the firearm is an ejection port of the firearm and wherein the catch element engages with the ejection port providing an interference fit between the firearm and the holster for securely retaining the firearm within the holster.

21. The method of claim 17 wherein the catch mechanism is positioned on one of a mounting base of the housing, a rotating plate of the housing, or a sliding plate of the housing.

* * * * *